United States Patent [19]

Von Kopp

[11] Patent Number: 4,811,728

[45] Date of Patent: Mar. 14, 1989

[54] RESPIRATOR HOOD

[75] Inventor: Guenter Von Kopp, Berlin, Fed. Rep. of Germany

[73] Assignee: Auergesellschaft GmbH, Berlin, Fed. Rep. of Germany

[21] Appl. No.: 913,119

[22] Filed: Sep. 29, 1986

Related U.S. Application Data

[63] Continuation-in-part of Ser. No. 627,441, Jul. 3, 1984, abandoned.

[30] Foreign Application Priority Data

Jul. 5, 1983 [DE] Fed. Rep. of Germany ..... 3324599

[51] Int. Cl.[4] ..... A62B 7/10

[52] U.S. Cl. ..... 128/201.25; 128/202.13

[58] Field of Search ..... 128/200.24, 201.22, 128/201.23, 201.24, 201.25, 201.28, 202.13, 205.25–205.27, 205.28, 206.27, 2, 5–7, 424, 171, 171.4, 173, 202, 205, 209.1, 209.2; 206/8, 38, 216, 223, 278, 282, 292, 514, 522, 601, 803

[56] References Cited

U.S. PATENT DOCUMENTS

| | | | |
|---|---|---|---|
| 2,222,635 | 6/1939 | Smith | 128/201.25 |
| 2,253,538 | 8/1941 | Sirch | 128/201.25 |
| 2,821,192 | 1/1958 | Monro | 128/201.25 |
| 2,979,170 | 4/1961 | Lotz | 190/42 |
| 3,071,134 | 1/1963 | Pate | 128/201.23 |
| 4,154,234 | 5/1979 | Warncke | 128/201.25 |
| 4,336,799 | 6/1982 | Almasi et al. | 128/201.24 |
| 4,467,795 | 8/1984 | Eckstein | 128/201.25 |
| 4,473,072 | 9/1984 | Walther | 128/201.25 |
| 4,508,115 | 4/1985 | Warncke | 128/201.23 |

FOREIGN PATENT DOCUMENTS

| | | | |
|---|---|---|---|
| 157780 | 7/1939 | Fed. Rep. of Germany | 206/8 |
| 2114584 | 10/1971 | Fed. Rep. of Germany | 128/202.13 |
| 50786 | 9/1926 | France | 128/201.25 |
| 815867 | 7/1937 | France | 2/6 |
| 2030869 | 4/1986 | United Kingdom | 128/202.13 |

*Primary Examiner*—Edward M. Coven
*Assistant Examiner*—Karin M. Reichle
*Attorney, Agent, or Firm*—Reed Smith Shaw & McClay

[57] ABSTRACT

A respirator hood designed as an emergency escape hood and air filter device. A head protector is provided, which is simultaneously designed as a packing and stand-by container. The crown area of the respirator hood is provided as an impact-resistant head protector with the respirator hood being an integral component thereof. The respirator hood in its unused state is packed and stored under moisture-proof conditions within the head protector.

5 Claims, 2 Drawing Sheets

RESPIRATOR HOOD

This is a continuation-in-part of copending application Ser. No. 627,441 filed on July 3, 1984, now abandoned.

SUMMARY OF THE INVENTION

In a respirator hood designed as an emergency escape hood filter device, a head protector is provided, which is simultaneously designed as a packing and stand-by container. The crown area of the respirator hood is designed as an impact-resistant head protector with the respirator hood as an integral component thereof. The respirator hood in its unused state is paced and stored under moisture-proof conditions within the protector.

FIELD OF THE INVENTION

The invention pertains to a protective respirator hood made of nonflammable material and in particular, to a hood which is maintained in a protective helmet for stand-by use.

BACKGROUND OF THE INVENTION

Respirator hoods are generally well known in the art. One such device is shown in West German Pat. No. 3 048 276. Hoods of this type are used in the case of fires, such as those in high-rise buildings, where the occupants are at risk from combustion gases, smoke, and falling objects. In order to assist these people to escape, escape hood filter devices have been devised, which filter the inhaled air in order to remove the toxic combustion gaes. These hoods also protect the eyes and head from the gases. Typically, these hoods consist of nonflammable textile materials which provide only limited protection for the head. These helmets cannot provide any protection from falling objects.

Generally, the filter materials used in the respirator filter are sensitive to moisture and, therefore, must be packed in a moisture-tight, stand-by container. The stand-by container is stored in a prominent and easily accessible place or attached to a wall in the building.

An object of the invention is to provide a respirator hood of the known type which is equipped with a head protector and which is simultaneously designed as a packing and stand-by container. Other advantages of this self-contained hood will become apparent from a perusal of the following description of a presently preferred embodiment of the invention taken in connection with the accompanying drawings.

PRESENTLY PREFERRED EMBODIMENT

Figure 1:
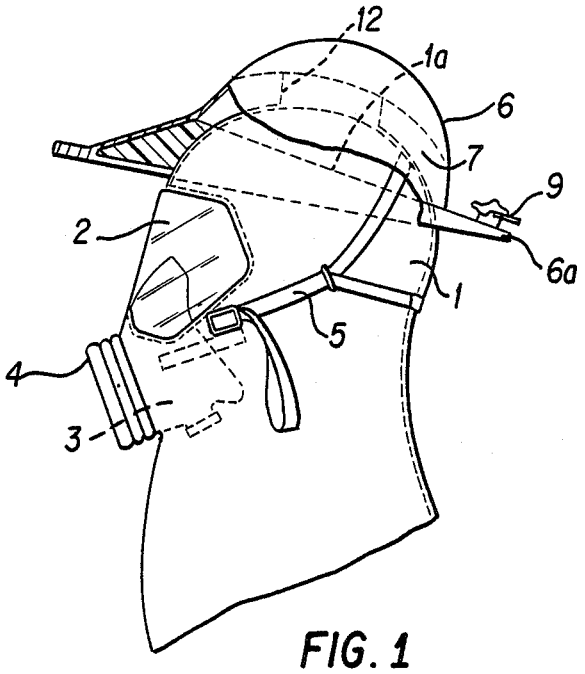
FIG. 1 shows a partially cut-away side view of the respirator hood with the head protector.

Referring to FIG. 1, a flexible respirator hood 1 for the covering the head is shown. Hood 1 consists of nonflammable textile material and is provided with a view window consisting of, for example, a transparent film or Plexiglas plastic 2, positioned in the field of vision. A half-mask 3 is provided as an inside mask for breathing. A respirator filter 4 is fitted to the front of the hood and mask and is maintained in position by an adjustable strap 5.

An impact-resistant head protector 6 is also used in conjunction with hood 1. Head protector 6 is preferably a safety helmet with appropriate internal fittings 7. The hood 1 is permanently attached at its upper part to the inside (padding) fittings 7 of the safety helmet 6, and is thus an integral component of the safety helmet.

Figure 2:
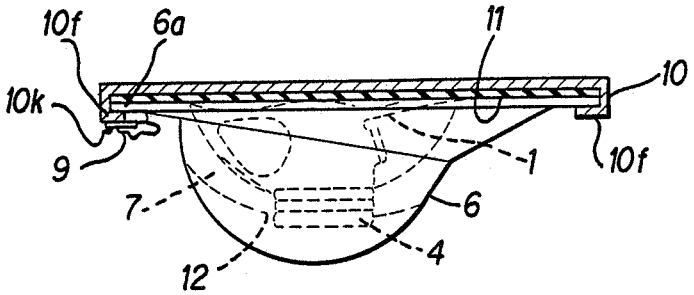
FIG. 2 shows the respirator hood inverted and packed in the head protector partially cut away, and parts shown in phantom view.

As shown in FIG. 2, clip-on toggle clamp 9 is arranged on brim 6*a* of the safety helmet 6. A cover 10, with a peripheral flange 10*f* extends around the brim of the safety helmet 6. A catch-10*k* protrudes out of the flange 10*f* associated with the back side of brim 6*a* having clamp 9. When helmet 6 is placed into cover 10 the toggle clamp 9 is fitted around 10*k* and closed, thus securing a snug fit. A planar seal 11 is also interposed between the brim 6*a* and cover 10. As can be seen from FIG. 2, head protector 6 in association with the cover 10 and seal 11, serves as a packing and storage container for the respirator hood 1. When the respirator hood is packed into the head protector 6, the respirator filter 4 is securely seated in a holder 12, forming part of the inside fittings 7. In the uper area of the hood 1, an opening 1*a* is provided (as best seen in FIG. 1), which matches the diameter of the respirator filter 4. The respirator filter 4 is inserted through this opening 1*a* into the holder 12 so as to securely hold it during hood assembly storage.

Figure 3:
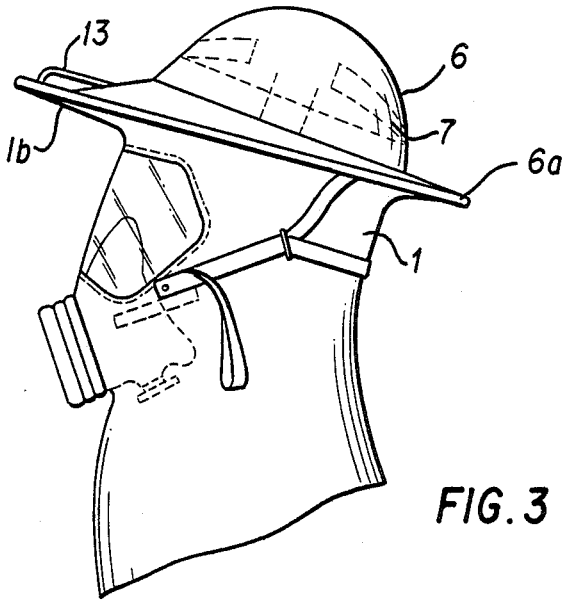
FIG. 3 shows another embodiment of a respirator hood with the head protector in partial phantom view.
Figure 4:
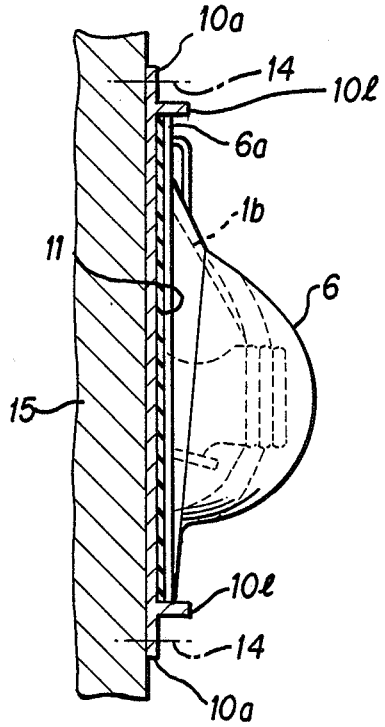
FIG. 4 shows the respirator hood embodiment of FIG. 3, packed away in the head protector and attached to a wall, partially in phantom, and partially cut away.

FIG. 3 shows an additional exemplary embodiment of a respirator hood 1 with an integral, impact-resistant head part 6, where the frontal brim 1*b* of hood 1 is rolled out sealing on its perimeter with brim 6*a*.

During storage, the brim portion of protector 6 is detachably fitted to cover 10*a* by its flanged outward portion 10*e*, that sealingly joins in its inner periphery with brim 6*a* of protector 6.

Head protector 6 also serves as a packing and stand-by container, which for this purpose is sealed all around the protector brim 6*a* by a cover 10*a*, which is designed as a pull-away closure. Helmet 6 can be attached at its projecting edge 10*a* by means of fasteners 14 to a wall 15.

The lip 10*e* on cover 10*a* is composed of a material that is sufficiently resilient and is sized so that it effects a pressure-fit seal with helmet brim 6*a* and seal 11, but which is adapted to allow manual detachment therefrom.

On the frontal part of brim 6*a* of the head protector 6, there is also provided a handle 13, by means of which the person needing the respirator hood in an emergency, can pull the head part 6, together with the integral respirator hood 1 stored in it, away from the cover 10*a* fastened to the wall 15.

While a presently preferred embodiment of the invention has been shown and described in particularity, it may be otherwise embodied within the scope of the appended claims.

What is claimed is:

1. In a respirator hood comprising a hood with a crown, said hood being of a non-flammable textile material adapted to substantially enclose the head and neck of a wearer with the crown of the hood fitting over and resting on the head of a wearer, and having a front window adapted to be positioned adjacent the wearer's eyes;

(a) an inside mask positioned within said hood and including a respirator filter extending through said hood and secured to the hood and fluidically communicating with the interior of said inside mask; and (b) an adjustable strap means for securing the inside mask and the respirator filter to the wearer; the improvement comprising in combination with the foregoing: (i) an impact-resistant head protector having an open face through which the hood extends during use and which is adjacent to, conforming to and covering the crown of the respirator hood; (ii) fitting means on the inside surface of said protector for attaching same to the adjacent crown; and (iii) removable cover means secured across the open face of the protector, to enclose the respirator hood and filter therein until needed.

2. A respirator hood according to claim 1, wherein said head protector is a safety helmet.

3. A respirator hood according to claim 1, wherein the head protector includes a circumferential brim and clip means provided in part on the brim of said head protector and in part on said cover means for releasably attaching the cover means to the head protector.

4. A respirator hood according to claim 1, wherein said fitting means of the head protector include a holder means in which the respirator filter is held to prevent same from moving while the hood is not in use.

5. A respirator hood according to claim 1, wherein the head protector has a circumferential brim and there is a handle positioned on the brim of the head protector.

* * * * *